US006106114A

United States Patent [19]

Sugiyama

[11] Patent Number: 6,106,114

[45] **Date of Patent: *Aug. 22, 2000**

[54] SHEET CONVEYING APPARATUS

[75] Inventor: Noriyuki Sugiyama, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,748

[22] Filed: Feb. 25, 1997

[30] Foreign Application Priority Data

Feb. 27, 1996 [JP] Japan ..... 8-039518

[51] Int. Cl.[7] ..... B41J 2/01

[52] U.S. Cl. ..... 347/104

[58] Field of Search ..... 347/104, 101; 271/127, 226, 242, 16 J, 271, 272, 273, 274; 400/636, 647, 647.1

[56] References Cited

U.S. PATENT DOCUMENTS 4,193,590 3/1980 Mongagnino ..... 271/119
5,152,622 10/1992 Rasmussen ..... 400/579
5,567,069 10/1996 Suzuki et al. ..... 400/636

FOREIGN PATENT DOCUMENTS 0 609 560 8/1994 European Pat. Off. .
63-037051 2/1988 Japan .

*Primary Examiner*—N. Le
*Assistant Examiner*—Michael S. Brooke
*Attorney, Agent, or Firm*—Fitzpatrick, Cella, Harper & Scinto

[57] ABSTRACT

The present invention provides a sheet conveying apparatus comprising a sheet support for supporting a sheet, a convey rotary member disposed downstream of the sheet support in a sheet conveying direction to convey the sheet supported by the sheet support, and a driven rotary member disposed in a confronting relation to the convey rotary member to be driven by the convey rotary member. Wherein the sheet support can be shifted so that, when the sheet supported by the sheet supporting means is urged toward a downstream side in the sheet conveying direction, a tip end of the sheet is directed to a position in the vicinity of a nip between the convey rotary member and the driven rotary member.

18 Claims, 9 Drawing Sheets

SHEET CONVEYING APPARATUS

BACKGROUND OF THE INVENTION

1. Field of the Invention

The present invention relates to a recording apparatus such as a printer, a copying machine, a word processor, a personal computer, a facsimile machine and the like, and more particularly, it relates to a sheet conveying apparatus used with such a recording apparatus.

2. Related Background Art

An example of a sheet conveying apparatus used with a conventional recording apparatus will be explained with reference to FIGS. 11, 12A and 12B.

FIG. 11 is a sectional view of a conventional sheet conveying apparatus using manual sheet insertion supply, and FIGS. 12A and 12B are explanatory sectional views of a conventional sheet conveying apparatus in which a sheet is automatically supplied by a sheet supply roller. In these sheet conveying apparatuses, a sheet S is rested on a support plate 1 each time, and each sheet is conveyed. In the first conventional example shown in FIG. 11, the support plate 1 is secured to a frame of a sheet conveying apparatus in such a manner that a sheet stacking surface 1*c* of the support plate 1 is disposed on a line (convey plane) a tangent to a nip between a convey roller 4 and an opposed driven roller 5. When a thickness t of a sheet S to be used is relatively great, as shown in FIG. 11, a tip end of an upper surface Sa of the sheet S is engaged by an outer peripheral surface of the driven roller 5, with the result that a tip end of a lower surface Sb of the sheet S cannot frequently be contacted with the convey roller 4.

In such a case, an urging force T generated by operator's manual insertion is applied to the sheet S on the support plate 1 in a sheet conveying direction A, so that the driven roller 5 is lifted together with an arm 5*a*. As a result, the tip end of the sheet S is forcibly inserted into the nip between the convey roller 4 and the driven roller 5 to contact the tip end of the lower surface Sb of the sheet S with the outer peripheral surface of the convey roller 4. In this way, a conveying force of the convey roller 4 rotated in the conveying direction is applied to the lower surface Sb of the sheet S, thereby conveying the sheet in the conveying direction A.

In the second conventional example shown in FIGS. 12A and 12B, at an upstream side of a nip between a convey roller 4 and a driven roller 5, a sheet supply roller 13 is mounted on a frame of the apparatus in such a manner that the sheet supply roller is disposed above a sheet stacking surface 1*c* of a sheet support plate 1 and a lowermost point of an outer peripheral surface of the sheet supply roller can be aligned with a line (convey plane) a tangent to the nip. The support plate 1 can be lifted and lowered and is always biased toward the sheet supply roller 13 by a compression spring 3.

When a sheet S is rested on the support plate 1, as shown in FIG. 12A, the support plate 1 is temporarily lowered to a position where the sheet supply roller 13 does not interfere with the sheet S. And, when the sheet S starts to be supplied, as shown in FIG. 12B, the support plate 1 lifted to contact the sheet S with the sheet supply roller 13. Then, the sheet supply roller 13 is rotated in a conveying direction A to apply a conveying force to an upper surface Sa of the sheet S, with the result that the sheet S is conveyed in the conveying direction with a conveying force T to contact a lower surface Sb of the sheet S with an outer peripheral surface of the convey roller 4. Then, the sheet S is further conveyed in the conveying direction A by a conveying force of the convey roller 4 rotated in the conveying direction to enter the sheet into the nip between the convey roller 4 and the driven roller 5, with the result that the sheet S is further conveyed in the conveying direction A while being pinched between the rollers 4 and 5.

However, in the first conventional example shown in FIG. 11, the sheet S is supported on the support plate 1 secured to the frame of the apparatus and the position of the lower surface Sb of the sheet S is maintained on the convey plane a. Thus, when a thickness t of the sheet S to be used is relatively great, at a position where the tip end of the upper surface Sa of the sheet S is contacted with the outer peripheral surface of the driven roller 5, a distance between the tip end of the lower surface Sb of the sheet S and the outer peripheral surface of the convey roller 4 becomes great. In this case, in order to introduce the sheet S into the nip between the convey roller 4 and the driven roller 5, the sheet must be forcibly advanced in the conveying direction A with the relatively great urging force T in opposition to the biasing force of a biasing means (not shown) (for biasing the driven roller 5 against the convey roller 4) while lifting the driven roller 5. Thus, the relatively great effect is required to contact the lower surface Sb of the sheet S with the peripheral surface of the convey roller 4, and the operability is worsened.

Further, when the driven roller 5 is lifted by urging the sheet S in the conveying direction A, since stress from the driven roller 5 is concentrated at the tip end of the upper surface Sa of the sheet S, the tip end of the sheet S may be damaged or deteriorated.

On the other hand, in the second conventional example shown in FIGS. 12A and 12B, the position of the upper surface Sa of the sheet S is maintained on the convey plane a (peripheral surface of the sheet supply roller 13). Thus, when a thickness t of the sheet S to be used is relatively great, at a position where the tip end of the lower surface Sb of the sheet S is contacted with the outer peripheral surface of the convey roller 4, a distance (in the conveying direction A) between the tip end of the sheet S and the nip (between the convey roller 4 and the driven roller 5) becomes relatively great and the lower surface Sb of the sheet S is greatly spaced apart from the convey plane a. As a result, when the sheet S supported on the support plate 1 is entered into the nip between the convey roller 4 and the driven roller 5 and is conveyed by these rollers, since the sheet S is curved along the outer peripheral surface of the convey roller 4, an excessive force is applied to the sheet S, thereby deteriorating the quality of the sheet S.

Further, since the upper surface Sa of the sheet S is not regulated by the driven roller 5 until the tip end of the sheet S is entered into and pinched by the convey roller 4 and the driven roller 5, but is merely regulated by the sheet supply roller 13, when the sheet S is conveyed while being curved along the outer peripheral surface of the convey roller 4, the tip end of the sheet S cannot frequently enter into the nip between the convey roller 4 and the driven roller 5, thereby causing the poor sheet conveyance.

In addition, if the thickness t of the sheet S is relatively great and rigidity of the sheet is relatively high, even when the conveying force of the convey roller 4 acts on the lower surface Sb of the sheet S, slip may occur between the lower surface Sb of the sheet S and the convey roller 4 not to enter the sheet into the nip between the driven roller 5 and the convey roller 4, thereby causing the poor sheet conveyance.

SUMMARY OF THE INVENTION

The present invention aims to eliminate the above-mentioned conventional drawbacks, and an object of the present invention is to provide a sheet conveying apparatus and a recording apparatus having such a sheet conveying apparatus, which can effectively convey a sheet, regardless of a thickness and rigidity of the sheet rested on a sheet supporting means.

To achieve the above object, the present invention provides a sheet conveying apparatus comprising a sheet supporting means for supporting a sheet thereon, a convey rotary member disposed downstream of the sheet supporting means in a sheet conveying direction to convey the sheet supported by the sheet supporting means, and a driven rotary member disposed in a confronting relation to the convey rotary member to be driven by rotation of the convey rotary member. Wherein the sheet supporting means can be shifted so that, when the sheet supported by the sheet supporting means is urged toward a downstream side in the sheet conveying direction, a tip end of the sheet is directed in the vicinity of a nip between the convey rotary member and the driven rotary member.

Preferably, the sheet supporting means is shifted so that the tip end of the urged sheet is directed to a position where the tip end of the sheet is contacted with both the convey rotary member and the driven rotary member.

Further, preferably, the driven rotary member is disposed at an upstream side and the convey rotary member is disposed at a downstream side so that, when the sheet supported by the sheet supporting means is urged toward the downstream side in the sheet conveying direction, the tip end of the sheet is urged against the driven rotary member and the sheet supporting means is lowered via the sheet by a reaction force generated due to the urged contact between the sheet and the driven rotary member.

DETAILED DESCRIPTION OF THE PREFERRED EMBODIMENTS

Now, a sheet conveying apparatus according to the present invention, and a recording apparatus (embodied as an ink jet recording apparatus) having such a sheet conveying apparatus will be explained with reference to the accompanying drawings.

Figure 1:
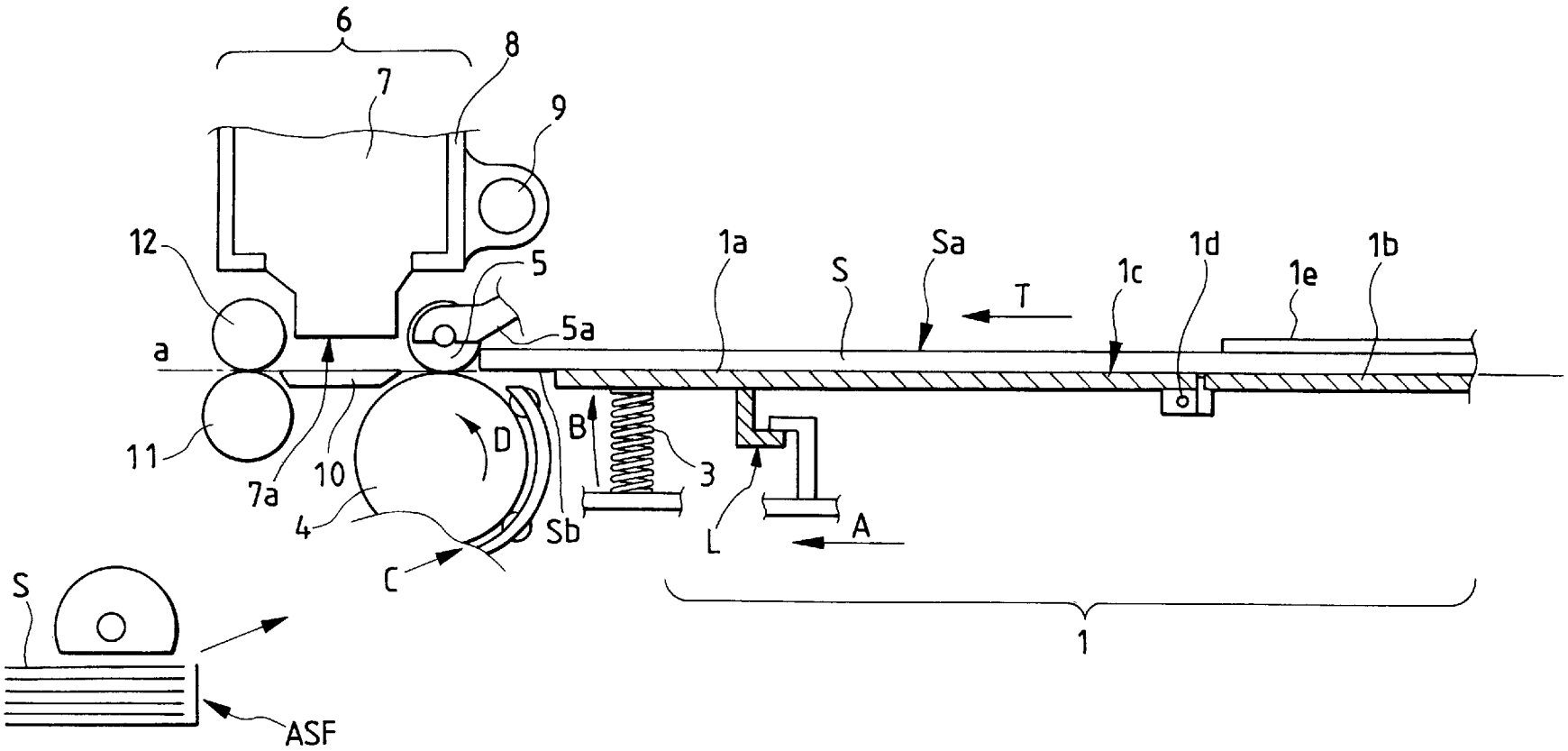
FIG. 1 is a sectional view of a recording apparatus having a sheet conveying apparatus according to the present invention.
Figure 2:
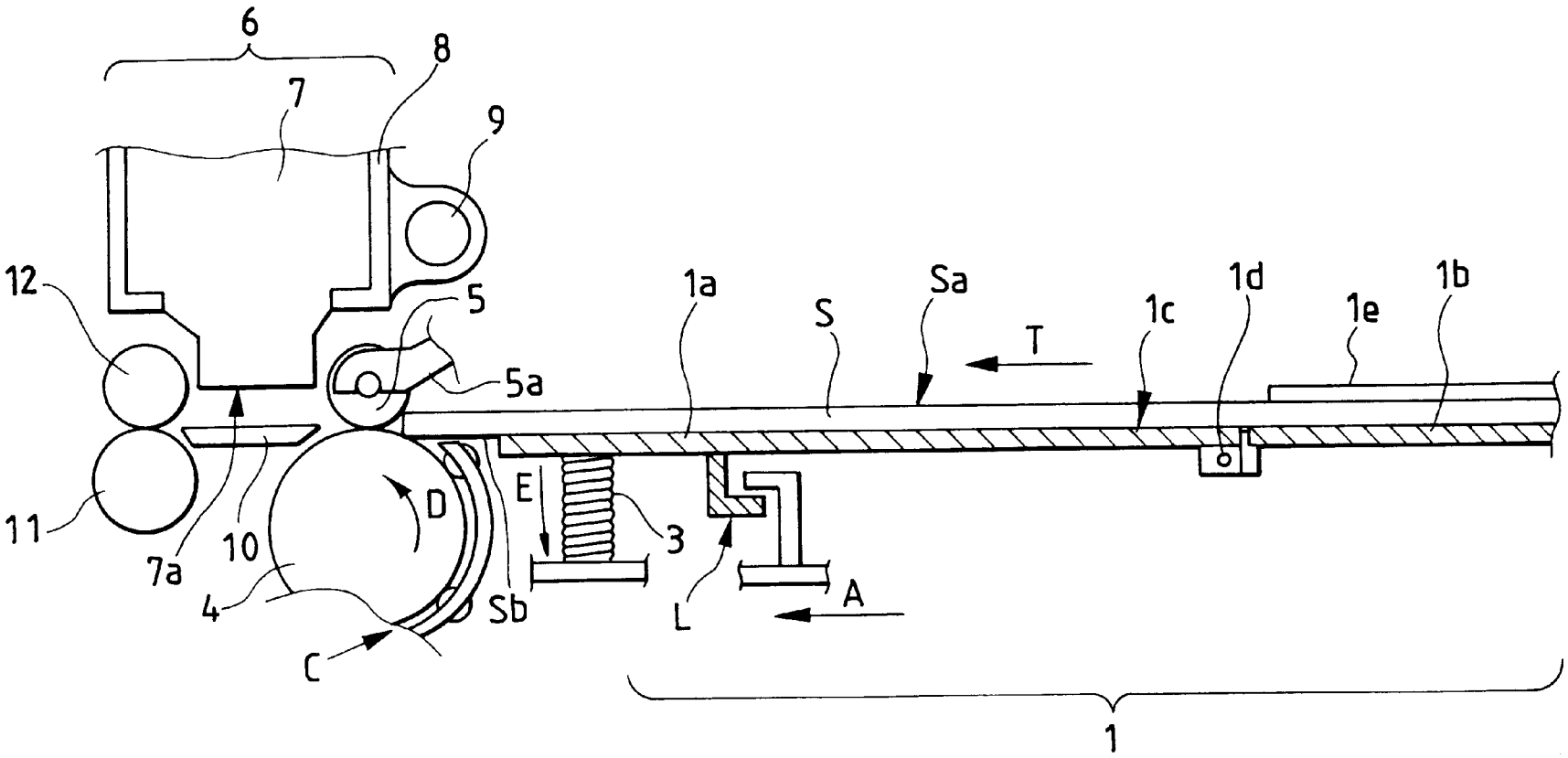
FIG. 2 is a sectional view showing a condition that a sheet supporting means of the recording apparatus of FIG. 1 is rocked or lowered.

In FIGS. 1 and 2, a support plate (sheet supporting means) 1 for supporting a sheet S made of paper or synthetic resin comprises a movable portion (stacking plate) 1*a* supported for pivotal movement around a pivot shaft 1*d*, and a fixed portion 1*b* secured to a frame of a sheet conveying apparatus. These portions are interconnected to provide a flat sheet stacking surface 1*c*.

At a left side (front side in FIGS. 1 and 2) of the movable and fixed portions 1*a*, 1*b*, there is provided a left edge guide (not shown) for regulating an end (along the sheet conveying direction) of the sheet S rested on the stacking surface 1*c* of the movable and fixed portions 1*a*, 1*b* (such an end is referred to as "lateral edge" of the sheet S, hereinafter) by abutting the lateral edge against the left edge guide. Further, the fixed portion 1*b* is provided with a right edge guide 1*e* movable in a direction (referred to as "width-wise direction" of the sheet S, hereinafter) perpendicular to the sheet conveying direction A and adapted to regulate the other lateral edge of the sheet S by abutting it against the other lateral edge. By the cooperation of the left edge guide and the right edge guide 1*e*, the sheet S is positioned in the width-wise direction.

A compression spring (first biasing means) 3 has one end supported by the frame of the apparatus and the other end engaged by a lower surface of the movable portion 1*a*. By a biasing force of the compression spring 3, the movable portion 1*a* is always biased in a direction shown by the arrow B (FIG. 1) around the pivot shaft 1*d* with a predetermined biasing force.

Further, there is provided a stopper L for regulating the extension of the compression spring 3 (in opposition to the biasing force of the compression spring 3) in such a manner that, when any external force other than a weight of the sheet S rested on the movable portion 1*a* does not act on the movable portion 1*a*, i.e., when the movable portion is in a position shown in FIG. 1, the stacking surface 1*c* of the movable portion 1*a* is aligned with a line (convey plane) a tangent to a nip between a convey roller (convey rotary member) 4 and a driven roller (driven rotary member) 5, which will be fully described later. The position or condition shown in FIG. 1 (before the movable portion 1*a* is rocked) is referred to as a "waiting condition" of the movable portion 1*a*.

At a downstream side of the support plate 1 in the sheet conveying direction, there is provided the convey roller (convey rotary member) 4 disposed below the convey plane a and rotatable with respect to the frame of the apparatus, and the driven roller (driven rotary member) 5 is disposed above the convey plane a in a confronting relation to the convey roller 4 and is urged against the convey roller 4 by a biasing means such as a spring so that the driven roller is rotated by rotation of the convey roller 4.

The rotation of the convey roller 4 is effected by a convey motor (not shown). When the sheet S is entered into a nip between the convey roller 4 and the driven roller 5 and is pinched by these rollers, the convey roller 4 cooperates with the driven roller 5 to convey the sheet S in the conveying direction A by a predetermined amount. At a downstream side of the convey roller 4 and the driven roller 5, there is disposed a recording portion (recording means) 6, and a platen 10 for supporting the sheet S is disposed below the convey plane a in a confronting relation to a recording head 7 of the recording portion 6.

The recording portion 6 includes a guide shaft 9 along which a carriage 8 mounting the recording head 7 thereon is reciprocally shifted in a direction perpendicular to the sheet conveying direction by means of a drive means. With this arrangement, the recording head 7 is scanned in the width-wise direction with respect to the sheet S conveyed on the platen 10 by the convey roller 4 and the driven roller 5, thereby recording an image on the sheet S.

As the recording means of the recording apparatus, an ink jet recording system for effecting the recording by discharging ink from the recording head 7 is used. That is to say, the recording head 7 is provided with small or minute liquid discharge openings (orifices), liquid passages, energy acting portions disposed within the liquid passages, and energy generating means for generating liquid droplet forming energy acting on the liquid in each acting portion.

Regarding the energy generating means for generating such energy, a recording method using electrical/mechanical converters such as piezo-electric elements, a recording method using energy generating means in which an electro-magnetic wave such as laser is illuminated on the liquid to heat the liquid and a liquid droplet is discharged by the heating of the liquid, or a recording method using energy generating means in which the liquid is heated by an electrical/thermal converter such as a heating element having a heat generating resistive body to discharge the liquid can be used.

Among these recording methods, a recording head used in the ink jet recording method for discharging the liquid by the thermal energy can achieve the recording with high resolving power because the liquid discharge openings (orifices) for forming the liquid droplets by discharging the recording ink can be arranged with high density. Further, a recording head in which the electrical/thermal converters are used as the energy generating means is preferable because it can easily be made compact, can effectively utilize advantages of IC techniques and micro-working techniques progress and reliability of which have remarkably been improved in a semi-conductor field, can be mounted with high density and can be made cheaper.

Further, the recording head 7 can be shifted so that a distance between a front surface (lower surface) 7*a* of the recording head 7 and the upper surface Sa of the sheet S supported on the platen 10 is properly maintained in accordance with a thickness t of the sheet S. At a downstream side of the platen 10, there are disposed a sheet discharge roller 11 for discharging the sheet S on which an image was recorded by the recording head (in response to image information) out of the apparatus, and spur wheels 12 urged against the discharge roller 11 by biasing means such as springs and rotatingly driven by rotation of the discharge roller 11. By the cooperation of the discharge roller 11 and the spur wheels 12, the sheet S on which the image was recorded is conveyed, and the sheet S is discharged onto a discharge tray (not shown) disposed outside the apparatus without smudging the recorded surface of the sheet S by using the spur wheels 12 having water-repelling ability.

The support plate 1 is used when the sheet S is supplied one by one by the operator's manual insertion; whereas, when a plurality of stacked sheets S are automatically supplied one by one, an automatic sheet feeder ASF is used. In the latter case, a plurality of sheets S are stacked on an automatic supply support plate disposed upstream of a sheet supply path C (FIGS. 1 and 2), and the sheets are separated and supplied one by one by means of a separation means. The separated sheet is conveyed to the nip between the convey roller 4 and the driven roller 5 through the sheet supply path C. Then, in the same manner as mentioned above, the image is recorded on the sheet by the recording head 7, and the recorded sheet is discharged out of the apparatus.

Next, the features of the present invention will be explained with reference to FIGS. 3 to 5.

When the sheet S is rested on the support plate 1, first of all, the recording head 7 is shifted so that the front surface 7*a* of the recording head 7 is positioned at a proper position corresponding to the thickness t of the sheet S. Since a method for shifting the recording head 7 in this way is already known in the art, explanation of such a method will be omitted.

Then, the sheet S is rested on the support plate 1 in a condition that the movable portion 1*a* is in the waiting condition, and the width-wise position of the sheet S is adjusted by the cooperation of the left guide and the right guide 1*e*. FIG. 3 shows a condition that the tip end of the upper surface Sa of the sheet S is contacted with the outer peripheral surface of the driven roller 5. In this condition, the tip end of the lower surface Sb of the sheet S is spaced apart from the outer peripheral surface of the convey roller 4.

In this case, when the thickness t of the sheet S is smaller than a radius r of the driven roller 5, if there is no deformation (for example, curl) in the sheet S, the greater the thickness t of the sheet S, the greater the distance between the tip end of the lower surface Sb of the sheet S and the outer peripheral surface of the convey roller 4. In this condition, even when the convey roller 4 is rotated in a direction shown by the arrow D (FIG. 3), the sheet S is not subjected to a conveying force.

Figure 3:
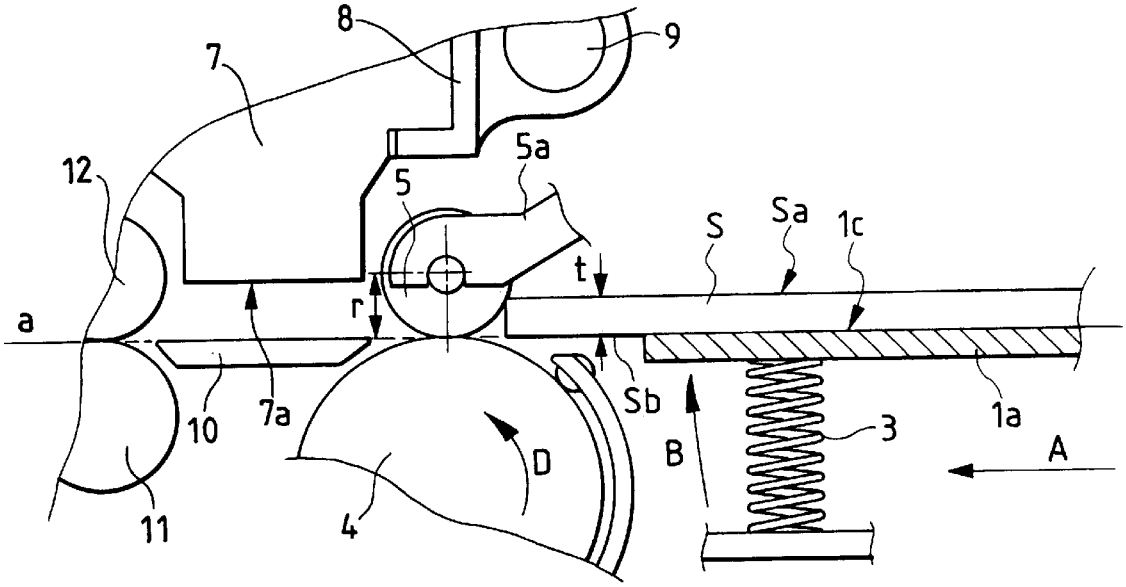
FIG. 3 is an enlarged view showing a main portion of FIG. 1.
Figure 4:
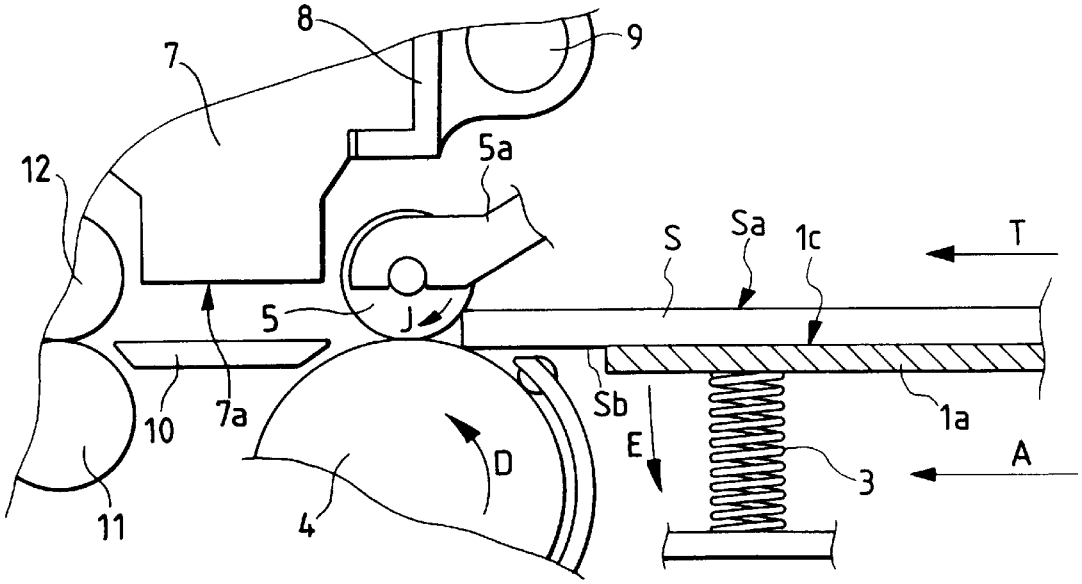
FIG. 4 is an enlarged view showing a main portion of FIG. 2.

FIG. 4 shows a condition that the sheet S in the condition shown in FIG. 3 is forcibly advanced in the conveying direction A with the urging force T by the operator. In this case, even when the sheet S has relatively great thickness and relatively high rigidity, by applying the urging force T to advance the sheet S in the conveying direction A, as a result of the fact that the tip end of the upper surface Sa of the sheet S urges the outer peripheral surface of the driven roller 5, the sheet S and the movable portion 1*a* are integrally lowered in a direction shown by the arrow E (FIG. 4) in opposition to the biasing force of the compression spring 3, so that the tip end of the lower surface Sb of the sheet S is directed to a position where it is contacted with the outer peripheral surface of the convey roller 4 (condition shown in FIG. 4).

In this condition, the tip end of the lower surface Sb of the sheet S can be subjected to the conveying force of the convey roller 4 (rotating in the direction D) directing toward the conveying direction A, with the result that the sheet S is entered into the nip between the convey roller 4 and the driven roller 5 and is pinched by these rollers. Then, the sheet S is sent to the downstream recording portion 6, where the ink image is recorded on the sheet. Thereafter, the recorded sheet is discharged out of the apparatus. Further, when the sheet S has relatively great thickness and relatively high rigidity, in order to positively convey the sheet S in the conveying direction A, it is desirable that the urging force T directing toward the conveying direction A is continuously applied to the sheet S until the sheet S is surely pinched between the convey roller 4 and the driven roller 5. In the illustrated embodiment, the urging force T directing toward the conveying direction A is obtained when the operator urges the sheet S in the conveying direction A.

With the arrangement as mentioned above, even when the sheet S having relatively great thickness and relatively high rigidity is conveyed from the support plate 1 to the recording portion 6, the movable portion 1*a* is lowered in accordance with the thickness t of the sheet S. Accordingly, unlike to the conventional techniques, there is no need to introduce the tip end of the sheet S into the nip between the convey roller 4 and the driven roller 5 while lifting the driven roller 5 by the tip end of the upper surface Sa of the sheet S. Thus, the sheet S can be inserted into the nip between the convey roller 4 and the driven roller 5 with less effort, thereby improving the operability.

Further, unlike to the conventional techniques, since the driven roller 5 is not forcibly lifted by the tip end of the upper surface Sa of the sheet S, the stress from the driven roller 5 is not concentrated at tip end of the upper surface Sa of the sheet S, thereby preventing the deterioration of the tip end of the sheet S. To the contrary, since the movable portion 1*a* is lowered together with the sheet S, the sheet S can be directed into the nip between the convey roller 4 and the driven roller 5 without acting the excessive force on the sheet S, thereby protecting the quality of the tip end of the sheet S. Accordingly, the sheet S having relatively great thickness and relatively high rigidity can easily be conveyed to the recording portion 6.

A relation between the forces in the above arrangement will be explained with reference to FIG. 5. In the waiting condition shown in FIG. 3, FIG. 5 shows forces acting on the driven roller 5 when the urging force T directing toward the conveying direction A (force directing toward the conveying direction A with which the tip end of the sheet S is urged against the driven roller 5; the force having a value obtained by subtracting a friction force between the lower surface Sb of the sheet S and the stacking surface 1*c* from the urging force applied by the operator) is applied to the driven roller 5, and the force of the compression spring 3. Incidentally, simplicity's sake of explanation, the conveying direction A is assumed as a horizontal direction.

Figure 5:
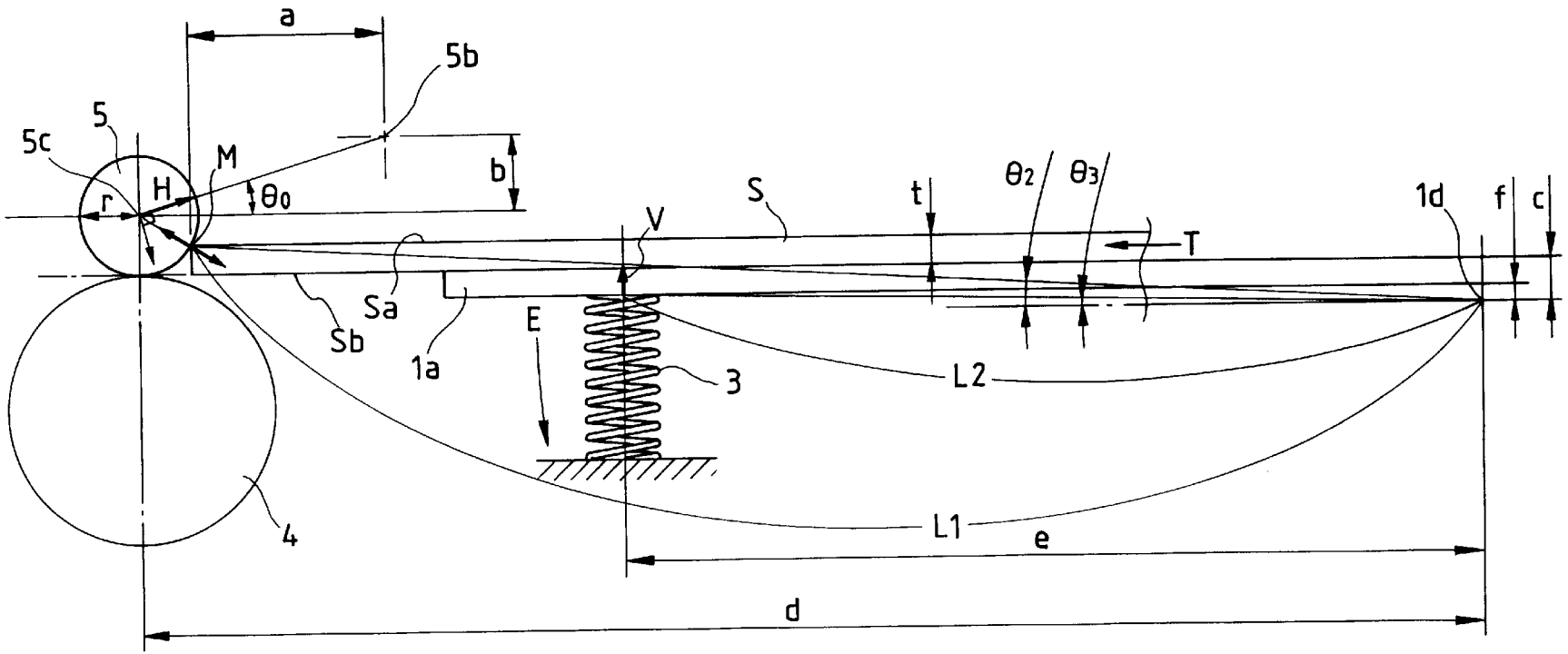
FIG. 5 is an explanatory view showing a relation between forces in the apparatus of FIG. 1.

In FIG. 5, forces T, N, P, H and V are as follows:

T: urging force directing to the conveying direction A applied by the operator;

N: force applied from the sheet S urged by the urging force T in the conveying direction A, at a contact position M between the sheet S and the driven roller 5;

P: biasing force of a spring (not shown) biasing the driven roller 5 downwardly (so that the driven roller is urged against the convey roller 4 with a force of P cos $\theta_0$);

H: a reaction force that the driven roller 5 urged by the sheet S with the urging force T directing to the conveying direction A is applied from a restraint portion; and V: extension force (elastic force) of the compression spring.

Further, angles $\theta_0$, $\theta_1$, $\theta_2$ and $\theta_3$ are as follows:

$\theta_0$: angle between a line extending from a rotation center 5*c* of the driven roller 5 to a rotation center 5*b* of an arm 5*a* supporting the driven roller 5 and a horizontal line passing through the rotation center 5*c* of the driven roller 5;

$\theta_1$: angle between a direction of the reaction force N at the contact position M and a vertical direction;

$\theta_2$: angle between a line $L_1$ extending from a rotation center 1*d* of the movable portion 1*a* to a contact position M and a horizontal line; and $\theta_3$: angle between a line $L_2$ extending from the rotation center 1*d* of the movable portion 1*a* to an intersection between a center of the compression spring 3 in a lengthwise direction and a bottom surface of the movable portion 1*a*, and a horizontal line.

In FIG. 5, the elastic force and position of the compression spring 3 are selected so that, before the driven roller 5 is lifted by the urging force T from the sheet S (i.e., before a force of N $\cos(\theta_1-\theta_2)$ directing upwardly in a vertical direction (as an component of the force N applied to the driven roller 5 from the sheet S, at the contact position M between the outer peripheral surface of the driven roller 5 and the tip end of the upper surface Sa of the sheet S urged by the urging force T in the conveying direction A) after coordinate axes are rotation-corrected by the angle $\theta_0$ in an anti-clockwise direction becomes greater than the force P biasing the driven roller 5 vertically downwardly in the rotation-corrected coordinate system), the compression spring 3 is compressed downwardly (i.e., the compression spring 3 is compressed by a force for rotating the movable portion 1*a* around the rotation center 1*d* in a direction E in FIG. 5 (as a component of the force N applied to the driven roller 5 from the sheet S at the contact position M), i.e., by a force of N $\cos(\theta_1+\theta_2)$ perpendicular to the line $L_1$).

Due to the balance between the forces acting on the driven roller 5, $$N\cos(\theta_1-\theta_0)=P \tag{1}$$

And, due to the balance between the forces acting on the sheet S, $$T=N\sin\theta_1 \tag{2}$$

From the above equations (1) and (2), when the value N is deleted, the following equation is obtained:

$$(T/\sin\theta_1)\cos(\theta_1-\theta_0)=P \tag{3}$$

Further, due to the balance between moments of force around the rotation center 1*d* of the movable portion 1*a*, $$L_1N\cos(\theta_1+\theta_2)=L_2V\cos\theta_3 \tag{4}$$

From the above equations (2) and (4), when the value N is deleted, the following equation is obtained:

$$(L_1T/\sin\theta_1)\cos(\theta_1+\theta_2)=L_2V\cos\theta_3 \tag{5}$$

Now, for example, in FIG. 5, a horizontal distance component a of a distance between the rotation center 5*b* of the arm 5*a* supporting the driven roller 5 and the contact position M is set to 40 mm, and a vertical distance component b of a distance between the rotation center 5*b* of the arm 5*a* supporting the driven roller 5 and the rotation center 5*c* of the driven roller 5 is set to 23 mm. Further, a vertical distance component c of a distance between the sheet stacking surface 1*c* of the movable portion 1*a* and the rotation center 1*d* of the movable portion 1*a* is set to 7 mm, and a horizontal distance component of a distance between the rotation center 5*c* of the driven roller 5 and the rotation center 1*d* of the movable portion 1*a* is set to 220 mm. Incidentally, the rotation center 5*c* of the driven roller 5, the rotation center of the convey roller 4, and the nip between the driven roller 5 and the convey roller 4 are aligned with each other in the vertical direction.

Further, a horizontal distance component of a distance between the center of the compression spring 3 and the rotation center 1*d* of the movable portion 1*a* is set to 140 mm, a vertical distance component of a distance between the intersection between the longitudinal center of the compression spring 3 and the bottom surface of the movable portion 1*a* and the rotation center 1*d* of the movable portion 1*a* is set to 3 mm, and a radius r of the driven roller 5 is set to 10 mm. In this case, when a sheet S having a thickness t of 5 mm is inserted in the condition shown in FIG. 5, the following values are obtained: $\theta_0 \cong 30°$, $\theta_1 = 60°$, $\theta_2 \cong 3.2°$, $\theta_3 \cong 1.2°$, $L_1 \cong 211.7$ mm and $L_2 \cong 140.0$ mm.

Further, when it is set to P=1000 gf, from the above equation (3), the value T becomes 1000 gf. That is to say, in the above-mentioned conventional examples, so long as the force T is smaller than 1000 gf, the driven roller 5 cannot be lifted to introduce the sheet S into the nip between the convey roller 4 and the driven roller 5.

In the illustrated embodiment, even if the force T is smaller than 1000 gf, the sheet S can be introduced into the nip between the convey roller 4 and the driven roller 5 to contact the sheet S with the convey roller 4, with the result that the conveying force of the convey roller 4 directing toward the conveying direction A acts on the sheet S to convey the sheet S toward the downstream direction. That is, even when the force T is smaller than 1000 gf, the compression spring 3 is compressed or contracted to contact the tip end of the lower surface Sb of the sheet S with the outer peripheral surface of the convey roller 4.

Now, when a free height of the compression spring 3 is set to 35 mm, a compressed height of the compression spring 3 after the sheet S was rested (on the support plate) becomes 32 mm, and a spring constant of the compression spring 3 is 50 gf/mm, in a condition that the sheet is rested, the elastic force V of the compression spring 3 becomes 150 gf. When this value is used in the above equation, T=190 gf is obtained. Accordingly, when the force T becomes greater than 190 gf, the movable portion 1*a* starts to rotate around the rotation center 1*d* in the direction E (FIG. 5). When it is so set that the tip end of the lower surface Sb of the sheet S is contacted with the outer peripheral surface of the convey roller 4 while the compression spring 3 is being compressed by about 5 mm from a set condition (in other words, by about 8 mm from the free length of 35 mm), since the elastic force V of the compression spring 3 and the urging force T (after the compression spring 3 was compressed by about 5 mm from the set condition) become V=400 gf and T=508 gf, respectively, the tip end of the lower surface Sb of the sheet S is contacted with the outer peripheral surface of the convey roller 4 before or when the force T reaches 508 gf.

That is to say, in the above-mentioned conventional examples, the sheet S cannot be introduced into the nip between the convey roller 4 and the driven roller 5 so long as the force T is smaller than 1000 gf; to the contrary, in the illustrated embodiment of the present invention, the sheet S can be introduced into the nip between the convey roller 4 and the driven roller 5 with the force T of 508 gf or less. As a result, the sheet S can be conveyed in the conveying direction by the conveying force of the convey roller 4 with such a smaller force. Accordingly, with the arrangement according to the illustrated embodiment, the urging force T that the operator must apply to the sheet S becomes ½ or more or less of the urging force in the conventional examples, thereby reducing the urging effort and improving the operability.

Figure 6:
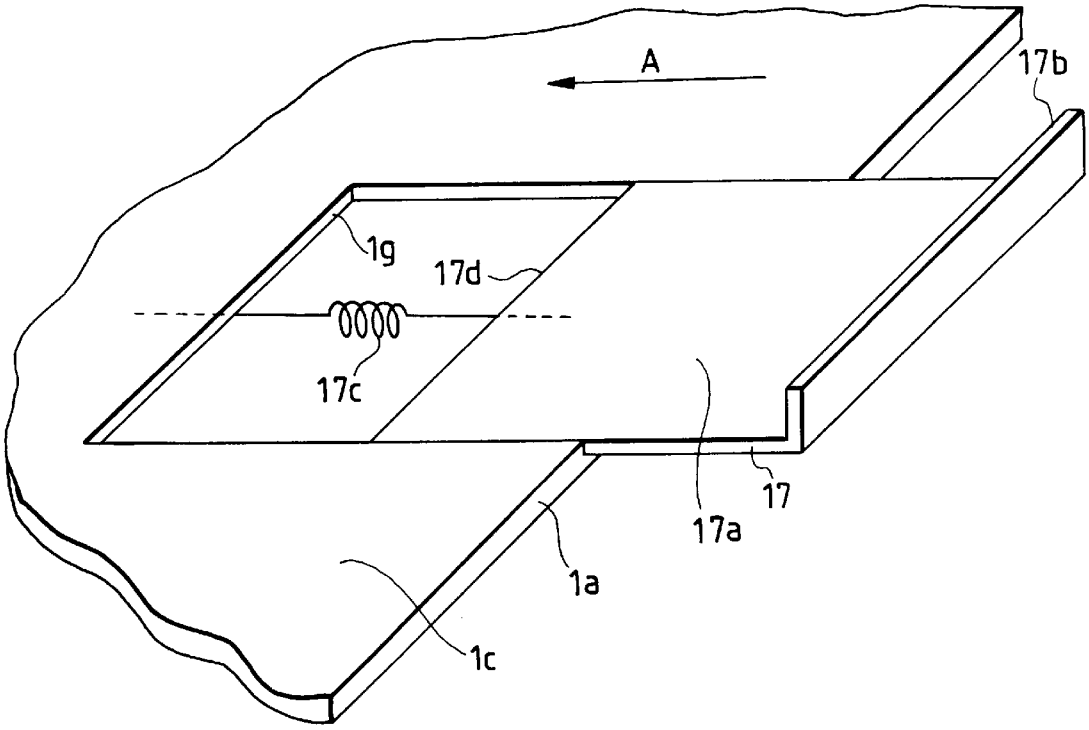
FIG. 6 is a perspective view of an urging means associated with the sheet supporting means of the apparatus of FIG. 1.

An arrangement shown in FIG. 6 may be added to the above-mentioned recording apparatus having the sheet conveying apparatus.

In this case, in place of the fact that the urging force T acting on the sheet S in the conveying direction A is applied by the operator's manual insertion, in order to provide a more stable urging force T, there is provided an urging member (urging means) 17 for urging a trail end (rear end) of the sheet S in the conveying direction A with a predetermined urging force via a biasing member such as a spring having a predetermined pulling force with respect to the movable portion 1*a* or the fixed portion 1*b* of the support plate 1.

As shown in FIG. 6, for example, an urging member 17 having a predetermined width is disposed at a rear end of the movable portion 1*a* in a substantially width-wise central portion of the sheet S so that a sheet stacking surface 17*a* of the urging member 17 can be shifted in the conveying direction A with being flush with the stacking surface 1*c* of the movable portion 1*a*, and a rear end abutment portion 17*b* having a predetermined height is uprightly formed on the sheet stacking surface 17*a* of the urging member 17 at a position corresponding to the trail end of the sheet S rested on the movable portion 1*a*.

A spring member (biasing member) 17*c* is engaged by lower surfaces of the movable portion 1*a* and the urging member 17 so that the urging member 17 is always biased toward the conveying direction A with respect to the movable portion 1*a* with the urging force T. In a condition that an abutment portion 17*d* of the urging member 17 abuts against an abutment portion 1*g* of the movable portion 1*a*, a distance between the rear end abutment portion 17*b* and the nip (between the convey roller 4 and the driven roller 5) along the conveying direction A is selected to be smaller than the length of the sheet S in the conveying direction, so that the trail end of the sheet S being used is positively subjected to the urging force T from the rear end abutment portion 17*b* of the urging member 17.

Incidentally, a right guide 1*e* is also arranged with respect to the movable portion 1*a*.

With this arrangement, since the urging force T (in the conveying direction A) acting on the sheet S is obtained by a pulling force of the spring member 17*c*, unstable urging applied by the operator's manual insertion can be eliminated, thereby providing the stable urging force T and improving the operability.

Next, an example that a sheet supply roller (supply rotary member) 13 is disposed above the movable portion 1*a* or the fixed portion 1*b* as an urging means for providing the urging force T in place of the fact that the urging force T (urging the sheet S in the conveying direction A) is obtained by the operator's manual insertion or the spring member 17*c* will be explained.

In FIGS. 7 to 10, a sheet supply roller 13 rotatably supported on a sheet supply roller shaft 13*a* held by a sheet supply roller holder 15 is disposed above the movable portion 1*a* in a confronting relation to the compression spring (first biasing means) 3. The sheet supply roller holder 15 is supported for pivotal movement around a sheet supply roller holder shaft 16 secured to the frame of the apparatus. Further, a leaf spring (second biasing means) 14 has one end secured to the apparatus frame and the other end engaged by the sheet supply roller holder 15. The sheet supply roller 13 has D-shaped cross-section and includes an acting surface 13*b* for applying the conveying force to the sheet S by contacting with the sheet rested on the movable portion 1*a*, and a non-acting surface 13*c* which is not contacted with the sheet S.

Figure 7:
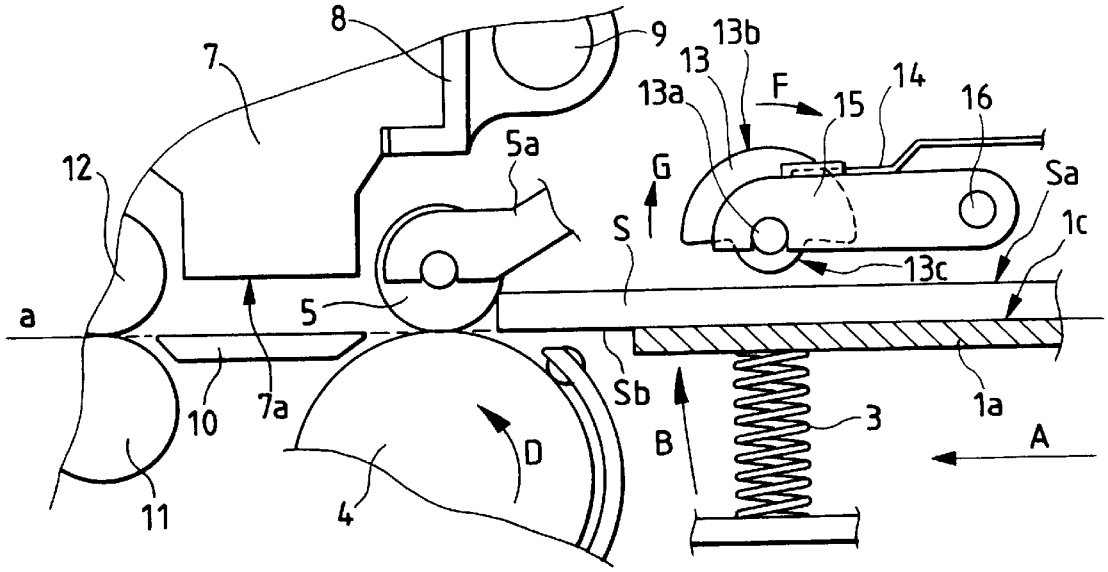
FIG. 7 is a sectional view of a recording apparatus having a sheet conveying apparatus according to the present invention.
Figure 8:
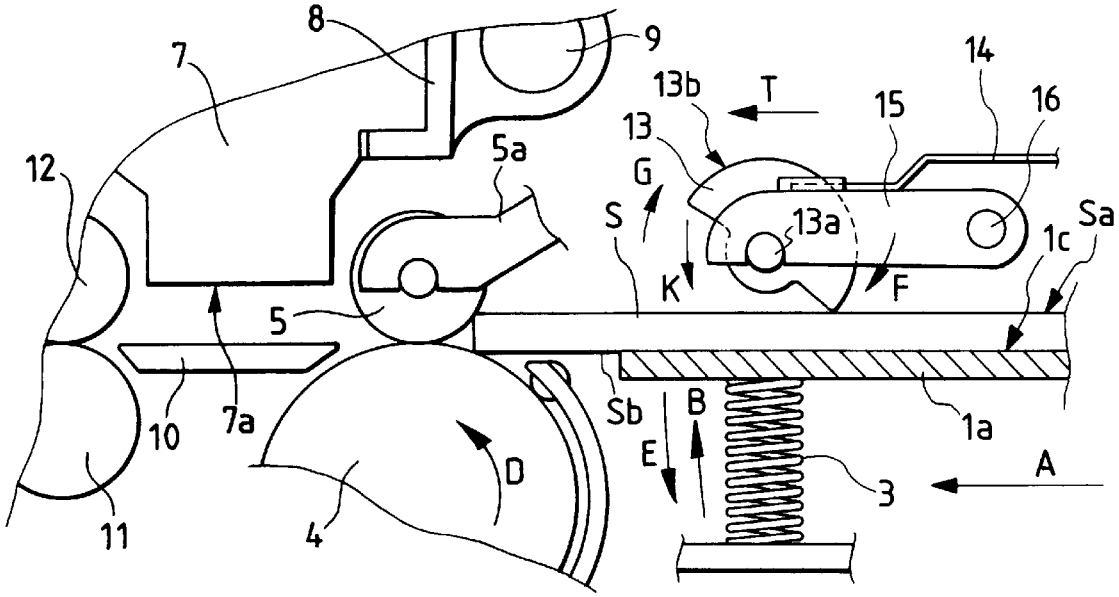
FIGS. 8 and 9 are sectional views showing a condition that a sheet supporting means of the recording apparatus of FIG. 7 is rocked.
Figure 9:
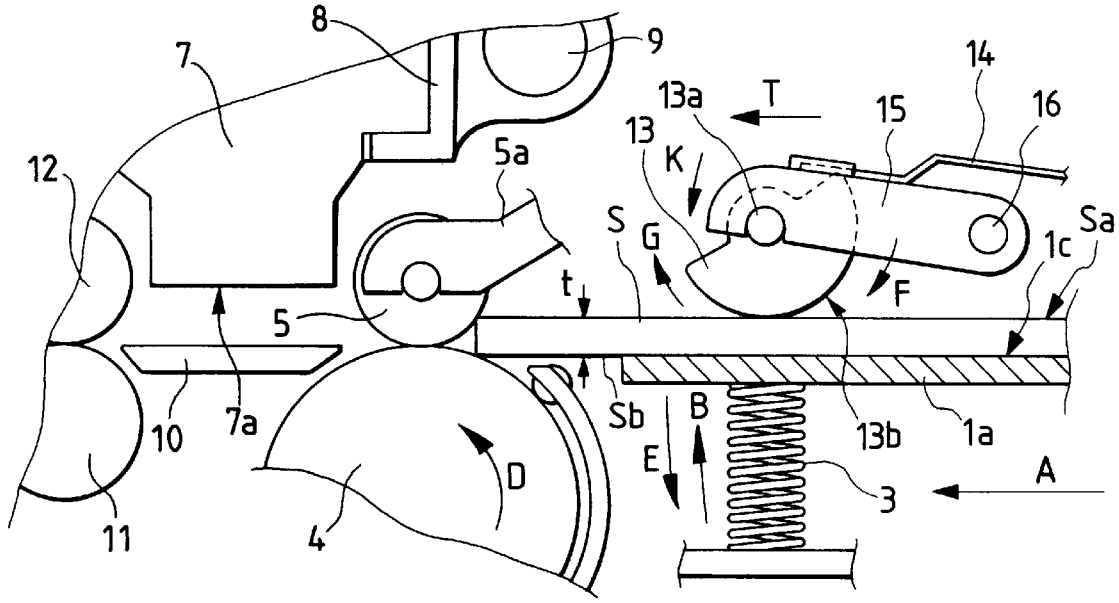

When the sheet supply roller 13 is in a waiting condition, as shown in FIG. 7, the non-acting surface 13*c* is opposed to the sheet S rested on the movable portion 1*a*; whereas, when the sheet S is to be supplied, as shown in FIGS. 8 and 9, the sheet supply roller 13 is rotated around the sheet supply roller shaft 13*a* in a direction shown by the arrow F, with the result that the acting surface 13*b* of the sheet supply roller 13 is contacted with the upper surface Sa of the sheet S to apply the conveying force to the sheet, thereby conveying the sheet S in the conveying direction A with the conveying force T. The sheet supply roller 13 is rotated by a sheet supply roller motor (not shown) or by a driving force of a convey roller motor (not shown) for driving the convey roller 4. When the sheet supply roller 13 is rocked together with the sheet supply roller holder 15 around the sheet supply roller shaft 16 in a direction shown by the arrow G in FIG. 7, the leaf spring 14 engaged by the sheet supply roller holder 15 biases the sheet supply roller holder 15 around the sheet supply roller shaft 16 in a direction shown by the arrow K.

In this case, regarding moments of force around the rotation center 1*d* of the movable portion 1*a*, it is selected so that the moment of force of the leaf spring 14 biasing the sheet S (rested on the movable portion 1*a*) toward the direction E in FIG. 8 via the sheet supply roller 13 is always greater than the moment of force of the compression spring 3 biasing the sheet S (rested on the movable portion 1*a*) toward the direction B in FIG. 8. Further, if there is no sheet S on the movable portion 1*a*, when the sheet supply roller 13 is directly contacted with the sheet stacking surface 1*c* of the movable portion 1*a*, the biasing force directing toward the direction E (FIG. 8) is generated.

With the arrangement as mentioned above, in a condition that the non-acting surface 13*c* of the sheet supply roller 13 is spaced apart from the support plate 1 with the non-acting surface confronting to the stacking surface 1*c* of the movable portion 1*a*, the sheet S is rested on the stacking surface 1*c* of the support plate 1 so that the tip end of the upper surface Sa of the sheet S abuts against the outer peripheral surface of the driven roller 5, as shown in FIG. 7.

Then, when the sheet supply roller 13 is rotated in the direction F in FIG. 8, the acting surface 13*b* of the sheet supply roller 13 is contacted with the upper surface Sa of the sheet S. In this case, regarding the moments of force around the rotation center 1*d* of the movable portion 1*a*, since the moment of force of the leaf spring 14 acting in the direction E (FIG. 8) is greater than the moment of force of the compression spring 3 acting in the direction B (FIG. 8), the sheet S is lowered together with the movable portion 1*a* toward the direction E in FIG. 8. In this case, since the sheet S is also subjected to the conveying force T directing toward the conveying direction A, as shown in FIG. 8, the sheet is directed to a position where the tip end of the upper surface Sa of the sheet S is urged against the outer peripheral surface of the driven roller 5 and the tip end of the lower surface Sb of the sheet S is urged against the outer peripheral surface of the convey roller 4 (i.e., predetermined position where the tip end of the sheet S is situated in the vicinity of the nip between the convey roller 4 and the driven roller 5).

From the condition shown in FIG. 8, when the sheet supply roller 13 is further rotated, since the tip end of the lower surface Sb of the sheet S is urged against the outer peripheral surface of the convey roller 4, the lowering of the sheet S in the direction E (FIG. 9) is suppressed due to rigidity of the sheet S. In accordance with the thickness t of the sheet S, the sheet supply roller holder 15 holding the sheet supply roller 13 is rotated around the sheet supply roller holder shaft 16 toward a direction shown by the arrow G (FIG. 9) in opposition to the biasing force of the leaf spring 14, with the result that the sheet supply roller 13 is lifted up to a condition shown in FIG. 9. While the acting surface 13*b* of the sheet supply roller 13 is acting on the upper surface Sa of the sheet S, the sheet supply roller 13 continues to apply the conveying force T (for conveying the sheet S in the conveying direction A) to the sheet S. In this condition, by rotating the convey roller 4 in a direction shown by the arrow D in FIG. 9, the conveying force of the convey roller 4 can be applied to the tip end of the lower surface Sb of the sheet S, thereby conveying the sheet S in the conveying direction A.

With the arrangement as mentioned above, the movable portion 1*a* is rotated in the direction E in FIG. 8 by the force of the leaf spring 14, with the result that the tip end of the sheet S rested on the movable portion 1*a* is directed to the predetermined position in the vicinity of the nip between the convey roller 4 and the driven roller 5. Accordingly, even if the thickness t of the sheet S to be used is relatively great, since the sheet S is less curved along the outer peripheral surface of the convey roller 4, the excessive force is not applied to the sheet S, thereby preventing the deterioration of the quality of the sheet S.

Further, since the sheet S is less curved along the outer peripheral surface of the convey roller 4, the tip end of the sheet S does not escape from the nip between the convey roller 4 and the driven roller 5, with the result that the tip end of the sheet can surely be entered into the nip, thereby surely conveying the sheet. Further, even when the sheet S has relatively great thickness t and relatively high rigidity, there is no slip between the lower surface Sb of the sheet S and the outer peripheral surface of the convey roller 4, with the result that the sheet S can surely be introduced into the nip between the convey roller 4 and the driven roller 5.

Figure 10:
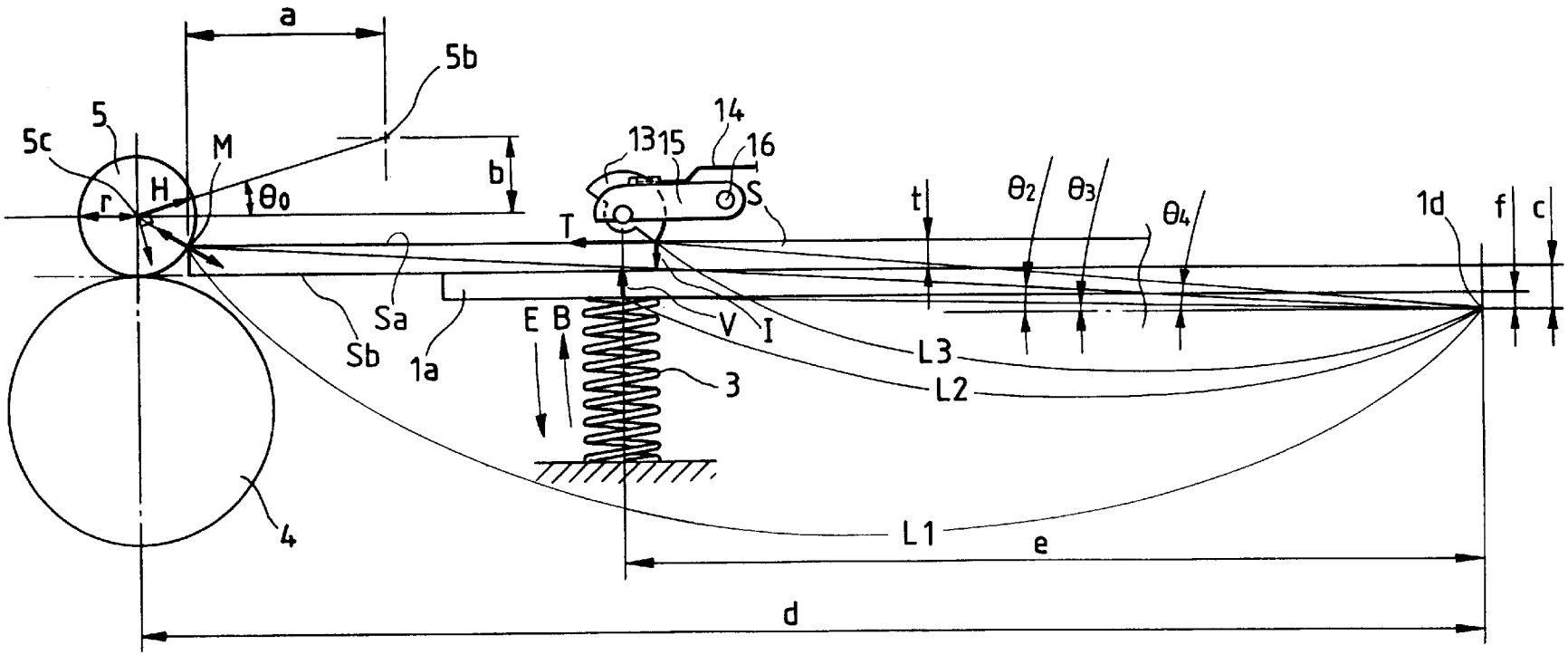
FIG. 10 is an explanatory view showing a relation between forces in the apparatus of FIG. 7.
Figure 11:
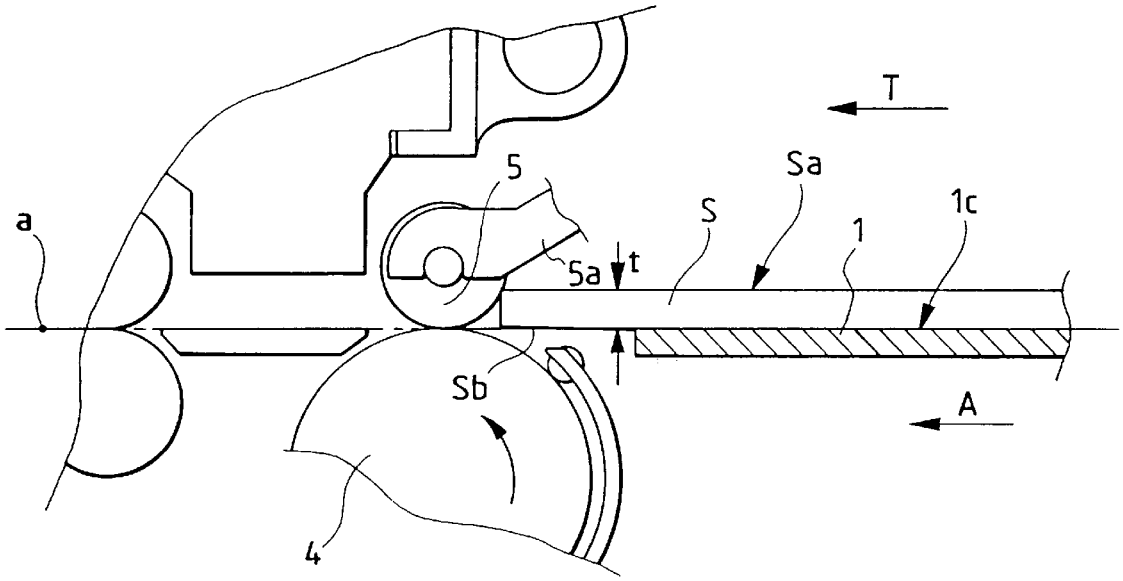
FIG. 11 PRIOR ART
FIG. 11 is an explanatory view for explaining a first conventional example.
Figure 12A:
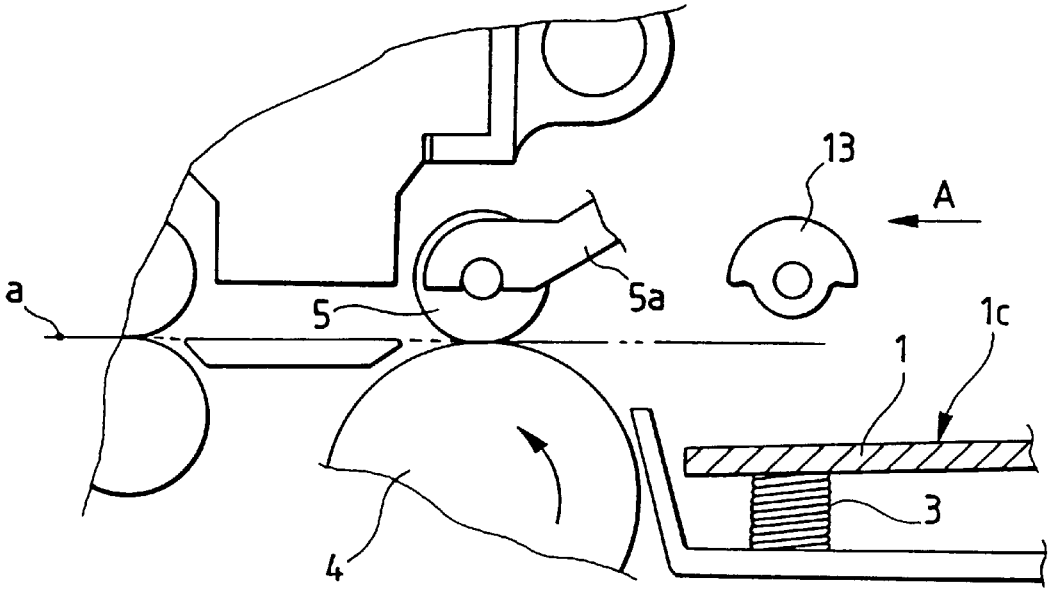
FIG. 12A PRIOR ART
FIGS. 12A and 12B are explanatory views for explaining a second conventional example.
Figure 12B:
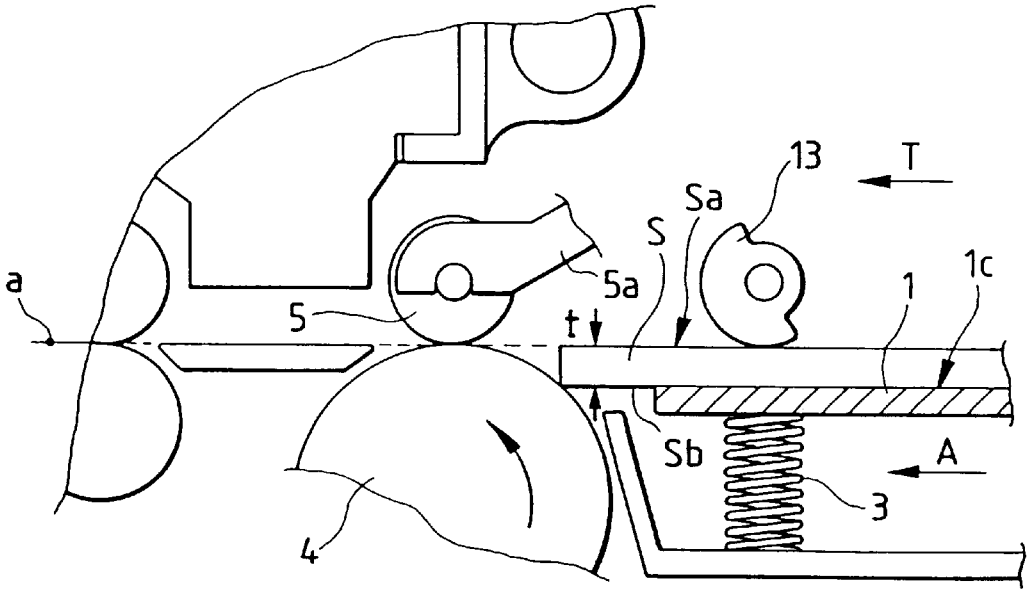
FIG. 12B PRIOR ART

A relation between forces in the above-mentioned arrangement will be concretely explained with reference to FIG. 10. In the waiting condition shown in FIG. 7, FIG. 10 shows forces acting on the driven roller 5 when the urging force T directing toward the conveying direction A (force directing toward the conveying direction A with which the tip end of the sheet S is urged against the driven roller 5; the force having a value obtained by subtracting a friction force between the lower surface Sb of the sheet S and the stacking surface 1*c* from the urging force of the sheet supply roller 13) is applied to the driven roller 5, and the force of the compression spring 3. Incidentally, elements same as those of the first embodiment shown in FIG. 5 are designated by the same reference numerals and explanation thereof will be omitted.

In FIG. 10, forces T, I and an angle $\theta_4$ are as follows:

T: urging force of the sheet supply roller 13 directing toward the conveying direction;

I: biasing force of the leaf spring 14; and $\theta_4$: angle between a horizontal line and a line $L_3$ extending from the rotation center 1*d* of the movable portion 1*a* to a point where the acting surface 13*b* of the sheet supply roller 13 is firstly contacted with the upper surface Sa of the sheet S.

In FIG. 10, a difference between FIG. 10 and FIG. 5 is that, when the sheet S is biased downwardly in a vertical direction with a force I by the biasing force of the leaf spring 14 via the sheet supply roller 13, a force component of the force I for rotation the movable portion 1*a* around the rotation center 1*d* of the movable portion 1*a* in a direction shown by the arrow E in FIG. 10 (i.e. force of I cos $\theta_4$ perpendicular to the line $L_3$) is generated and the urging force T is generated by the sheet supply roller 13.

Regarding the moments of force around the rotation center 1*d* of the movable portion 1*a*, since the moment of force of the leaf spring 14 biasing the sheet S (rested on the movable portion 1*a*) toward the direction E in FIG. 8 via the sheet supply roller 13 at the position where the sheet supply roller 13 acts on the sheet S is always greater than the moment of force of the compression spring 3 biasing the sheet S (rested on the movable portion 1*a*) toward the direction B in FIG. 8, a relation between the moments of force around the rotation center 1*d* of the movable portion 1*a* becomes as follows:

$$L_3 I \cos\theta_4 > L_2 V \cos\theta_3 \quad (6)$$

Further, in an arrangement in which the movable portion 1*a* is rotated around the rotation center 1*d* in the direction E in FIG. 10 so that the tip end of the lower surface Sb of the sheet S is contacted with the outer peripheral surface of the convey roller 4 until the compression spring 3 is compressed by about 5 mm from the set condition and the force V becomes 400 gf, for example, when $L_3 \cong 135.3$ mm and $\theta_4 \cong 5.1°$, from the above relation (6), a following relation is obtained:

$$I > 415 \text{ gf}$$

That is to say, when the force for starting the rotation of the sheet supply roller 13 in the direction G in FIG. 7 is set to be greater than 415 gf, by acting the sheet supply roller 13 on the sheet S, in a condition that the sheet supply roller 13 is not rotated in the direction G in FIG. 7, the movable portion 1*a* is rotated around the rotation center 1*d* in the direction E in FIG. 10, with the result that the tip end of the lower surface Sb of the sheet S is contacted with the outer peripheral surface of the convey roller 4. In this case, the biasing force I is varied with the compressed amount of the compression spring 3 until the tip end of the lower surface Sb of the sheet S is contacted with the outer peripheral surface of the convey roller 4.

Further, when a coefficient of friction between the action surface 13*b* of the sheet supply roller 13 and the upper surface Sa of the sheet S is $\mu 1$, and a coefficient of friction between the lower surface Sb of the sheet S and the stacking surface 1*c* is $\mu 2$ and when any friction forces other than the above friction forces (for example, a friction force generated the end of the sheet S and the left end guide, and the like) is negligible, the urging force T for urging the sheet S in the conveying direction A becomes as follows:

$$T = I(\mu 1 - \mu 2) \quad (7)$$

Now, for example, when $\mu 1 = 1.8$ and $\mu 2 = 0.5$, from the above equation (7), the following relation is obtained:

$$T = 539.5 \text{ gf}$$

That is to say, by the urging force smaller than or equal to 539.5 gf, as shown in FIG. 8, the sheet S can be directed to a position where the tip end of the upper surface Sa of the sheet S is contacted with the outer peripheral surface of the driven roller 5 and the tip end of the lower surface Sb of the sheet S is contacted with the outer peripheral surface of the convey roller 4. Further, when such relations are established, since the urging force T can be set greater, the driving force of the convey roller 4 can be smaller, with the result that the motor acting as the drive source can be made smaller, thereby making the apparatus itself compact and cheaper.

Further, regarding the moments of force around the rotation center 1*d* of the movable portion 1*a*, when the moment of force of the leaf spring 14 biasing the sheet S (rested on the movable portion 1*a*) in the direction E in FIG. 8 at the position where the sheet supply roller 13 acts on the sheet S is always smaller than the moment of force of the compression spring 3 biasing the sheet S (rested on the movable portion 1*a*) in the direction B in FIG. 8 (i.e., when the following relation (8) is satisfied), the change in condition of various elements (such as the sheet S, movable portion 1*a* and the like) effected by the urging force T becomes the same as that shown in FIG. 5. However, in comparison with FIG. 5, there are differences that the urging force T is generated by the sheet supply roller 13 and that, regarding the moments of force around the rotation center 1*d* of the movable portion 1*a*, the moment of force of the leaf spring 14 (biasing force I) is added:

$$L_3 I \cos\theta_4 < L_2 V \cos\theta_3 \quad (8)$$

That is to say, the elastic force and position of the compression spring 3 are selected so that, before the driven roller 5 is lifted by the urging force T from the sheet S (i.e., before a force of $N \cos(\theta_1 - \theta_2)$ directing upwardly in a vertical direction (as a component of the force N applied to the driven roller 5 from the sheet S, at the contact position M between the outer peripheral surface of the driven roller 5 and the tip end of the upper surface Sa of the sheet S urged by the urging force T in the conveying direction A) after coordinate axes are rotation-corrected by the angle $\theta_0$ in an anti-clockwise direction becomes greater than the force P biasing the driven roller 5 vertically downwardly in the rotation-corrected coordinate system), the compression spring 3 is compressed downwardly (i.e., the compression spring 3 is compressed by a force for rotating the movable portion 1*a* around the rotation center 1*d* in the direction E in FIG. 10 (as a component of the force N applied to the driven roller 5 from the sheet S at the contact position M), i.e., by a force of $N \cos(\theta_1 + \theta_2)$ perpendicular to the line $L_1$, and a force for rotating the movable portion 1*a* around the rotation center 1*d* of the movable portion 1*a* in the direction E in FIG. 10 (as a component of the force I applied to the sheet S from the leaf spring 14 via the sheet supply roller 13), i.e., by a force of $I \cos\theta_4$ perpendicular to the line $L_3$).

As shown in FIG. 10, when the urging force T from the sheet supply roller 13 is applied to the sheet S rested on the support plate 1 in such a manner that the sheet S is advanced toward the conveying direction A, the balance of the forces acting on the driven roller 5 becomes as follows:

$$N \cos(\theta_1 - \theta_0) = P \quad (1)$$

Further, due to the balance between the forces acting on the sheet S, $$T = N \sin\theta_1 \quad (2)$$

From the above equations (1) and (2), when the value N is deleted, the following equation is obtained:

$$(T/\sin\theta_1)\cos(\theta_1 - \theta_0) = P \quad (3)$$

Further, due to the balance between moments of force around the rotation center 1*d* of the movable portion 1*a*, $$L_1 N \cos(\theta_1 + \theta_2) + L_3 I \cos\theta_4 = L_2 V \cos\theta_3 \quad (9)$$

From the above equations (2) and (9), when the value N is deleted, the following equation is obtained:

$$(L_1 T/\sin\theta_1)\cos(\theta_1 + \theta_2) + L_3 I \cos\theta_4 = L_2 V \cos\theta_3 \quad (10)$$

In this case, as described in the aforementioned embodiment, the urging force T acting on the sheet S in the conveying direction is:

$$T = I(\mu 1 - \mu 2) \quad (7)$$

And, from the above equations (7) and (10), when the value T is deleted, the following equation is obtained:

$$(L_1 I(\mu 1-\mu 2)/\sin\theta_1)\cos(\theta_1+\theta_2)+L_3 I\cos\theta_4=L_2 V\cos\theta_3 \quad (11)$$

Now, for example, with the arrangement similar to the aforementioned embodiment, since the elastic force V of the compression spring 3 after the sheet S is set is 150 gf, the biasing force I of the leaf spring 14 has the following relation, from the above relation (8):

$$I<155.8 \text{ gf} \quad (12)$$

That is to say, when the biasing force I of the leaf spring 14 is smaller than 155.8 gf, the compression spring 3 is not compressed only by a force at a position where the sheet supply roller 13 acts on the sheet S. Further, when the value V=150 gf is entered into the above equation (11), the following value is obtained:

$$I=75.5 \text{ gf}$$

When this value is entered into the above equation (7), the following value is obtained:

$$T=98.2 \text{ gf}$$

In this case, since I=75.5 gf satisfies the above relation (12), if the value T becomes greater than 98.2 gf, the movable portion 1*a* starts to rotate around the rotation center 1*d* in the direction E in FIG. 10.

Further, when the biasing force I of the leaf spring 14 is smaller than 155.8 gf, the compression spring 3 cannot be compressed only by the force at the position where the sheet supply roller 13 acts on the sheet S, but, at the contact position M, by the aid of the force component of N $\cos(\theta_1+\theta_2)$ perpendicular to the line $L_1$ (of the reaction force N of the sheet S applied from the driven roller 5), the compression spring 3 is compressed. That is to say, when the biasing force I of the leaf spring 14 is 155.8 gf, from the above equation (11), the value V becomes 309.5 gf, and the compression spring 3 is compressed by about 3 mm from the set condition.

In this case, when the value V=309.5 gf is entered into the above relation (8), the following relation is obtained:

$$I<321.5 \text{ gf} \quad (13)$$

In order to further compress the compression spring 3 from the above condition only by the force of the sheet supply roller 13 acting on the sheet S, it is required that the biasing force I of the leaf spring 14 is greater than 321.5 gf.

However, since the elastic force V of the compression spring 3 when the tip end of the lower surface Sb of the sheet S is urged against the outer peripheral surface of the convey roller 4 is 400 gf, from the above equation (11), the value I becomes 201.4 gf. When this value is entered into the above equation (7), the value T becomes 261.8 gf. That is to say, when the biasing force I of the leaf spring 14 becomes about 201.4 gf and the urging force T becomes about 261.8 gf, by the aid of the force of N $\cos(\theta_1+\theta_2)$ perpendicular to the line $L_1$ (as a component of the reaction force N of the sheet S applied by the driven roller 5 at the contact position M, the compression spring 3 is compressed, with the result that the sheet is directed to the position where the tip end of the upper surface Sa of the sheet S is contacted with the outer peripheral surface of the driven roller 5 and the tip end of the lower surface Sb of the sheet S is contacted with the outer peripheral surface of the convey roller 4, thereby achieving the same effect as the aforementioned embodiment.

In this case, since the biasing force I of the leaf spring 14 is 201.4 gf, the above relation (13) is satisfied, with the result that the compression spring 3 cannot be compressed only by the force of the sheet supply roller 13 acting on the sheet S.

Further, when such a force relation is established, since the elastic force of the leaf spring 14 biasing the sheet supply roller 13 can be set smaller, the assembling ability can be improved.

Regarding the moments of force around the rotation center 1*d* of the movable portion 1*a*, the moment of force of the leaf spring (second biasing means) 14 for biasing the movable portion 1*a* in the direction E in FIG. 9 via the sheet supply roller 13 at the position where the sheet supply roller 13 acts on the sheet S was always greater than the moment of force of the compression spring (first biasing means) 3 for biasing the movable portion 1*a* in the direction B in FIG. 9. However, as an another arrangement, when the sheet supply roller 13 is contacted with the sheet S, the moment of force of the leaf spring 14 for biasing the movable portion 1*a* in the direction E in FIG. 9 via the sheet supply roller 13 may become smaller than the moment of force of the compression spring 3 for biasing the movable portion 1*a* in the direction B in FIG. 9, and, when a predetermined time is elapsed after the sheet supply roller 13 starts to supply the sheet S, the moment of force of the leaf spring 14 for biasing the movable portion 1*a* in the direction E in FIG. 9 via the sheet supply roller 13 may become greater than the moment of force of the compression spring 3 for biasing the movable portion 1*a* in the direction B in FIG. 9. Also in this case, the same technical advantage can be obtained.

Regarding the moments of force around the rotation center 1*d* of the movable portion 1*a*, the moment of force of the leaf spring (second biasing means) 14 for biasing the movable portion 1*a* in the direction E in FIG. 10 via the sheet supply roller 13 at the position where the sheet supply roller 13 acts on the sheet S was always greater than the moment of force of the compression spring (first biasing means) 3 for biasing the movable portion 1*a* in the direction B in FIG. 10. However, as a further arrangement, when the sheet supply roller 13 is contacted with the sheet S, the moment of force of the leaf spring 14 for biasing the movable portion 1*a* in the direction E in FIG. 10 via the sheet supply roller 13 may become greater than the moment of force of the compression spring 3 for biasing the movable portion 1*a* in the direction B in FIG. 10, and, when a predetermined time is elapsed after the sheet supply roller 13 starts to supply the sheet S, the moment of force of the leaf spring 14 for biasing the movable portion 1*a* in the direction E in FIG. 10 via the sheet supply roller 13 may become smaller than the moment of force of the compression spring 3 for biasing the movable portion 1*a* in the direction B in FIG. 10. Also in this case, the same technical advantage can be obtained.

Further, while an example that the sheet supply roller 13 is disposed above the movable portion 1*a* in a confronting relation to the compression spring 3 was explained, the sheet supply roller may be disposed above the fixed portion 1*b*. Furthermore, when the urging force T for urging the sheet S in the conveying direction A is obtained from the conveying force of the sheet supply roller 13, by providing a known separation means (for example, friction separation or pawl separation) on the support plate 1, a plurality of sheets S can be stacked on the support plate 1 and the sheets S can be separated and supplied one by one by such separation means. Incidentally, in case of the pawl separation, when the sheet S not to be separated is rested on the support plate 1, the separation pawl must have to be retarded.

Further, while an example that the support plate 1 is constituted by the movable portion 1*a* and the fixed portion 1*b* was explained, the support plate 1 may be constituted by the movable portion 1*a* alone. Furthermore, the biasing means for biasing the sheet supply roller 13, movable portion 1*a*, urging member 17 and the like are not limited to the illustrated springs, but may be constituted by any other urging means having a biasing ability.

In addition, while an example that the sheet supply roller 13 and the movable portion 1*a* are pivotally supported was explained, these elements may be supported for parallel movement, respectively. Further, while an example that the sheet made of paper or synthetic resin is used was explained, the recording can be effected on a sheet having relatively high rigidity and made of metal or the like.

Further, the above-mentioned ink jet recording apparatus can be used as an image output terminal equipment of an information processing system such as a computer, or as a copying machine in combination with a reader, or as a facsimile having transmission function.

Lastly, while an example that the ink jet recording system is used as the recording means was explained, the recording system associated with the present invention is not limited to the ink jet recording system, but a heat-transfer recording system, a heat-sensitive recording system, an impact recording system such as a wire dot recording system, or other recording system can be used. Further, the recording system is not limited to the serial recording system, but a so-called line recording system can be used.

What is claimed is:

1. A sheet conveying apparatus comprising:

sheet supporting means for supporting a sheet;

a convey rotary member disposed downstream of said sheet supporting means in a sheet conveying direction for conveying the sheet supported on said sheet supporting means;

a driven rotary member, disposed in a confronting relation to said convey rotary member, to form a nip with and be driven by said convey rotary member, wherein a radius of the driven rotary member is larger than a thickness of the sheet supported on said sheet supporting means; and biasing means for biasing and maintaining said sheet supporting means so that a tip end of the sheet supported on said sheet supporting means is opposed to said driven rotary member;

wherein a bias force of said biasing means is sufficiently light so that said sheet supporting means and the sheet are integrally shifted against the bias force of said biasing means by a reaction force applied from said driven rotary member to the tip end of the sheet so that, when the sheet supported on said sheet supporting means is urged toward a downstream side in the sheet conveying direction, the tip end of the sheet is directed to a position adjacent the nip between said convey rotary member and said driven rotary member.

2. A sheet conveying apparatus according to claim 1, wherein said sheet supporting means is shiftable so that the tip end is directed to a position where the tip end of the sheet is contacted with both said convey rotary member and said driven rotary member.

3. A sheet conveying apparatus according to claim 2, wherein said driven rotary member is disposed at an upper side and said convey rotary member is disposed at a lower side, and wherein, when the sheet supported by said sheet supporting means is urged toward the downstream side in the sheet conveying direction, the tip end of the sheet is urged against said driven rotary member and said sheet supporting means is lowered by said reaction force, which is applied from said drive rotary member to said sheet supporting means through the sheet.

4. A sheet conveying apparatus according to any one of claims 1 to 3, further comprising an urging means for urging the sheet supported by said sheet supporting means toward the downstream side in the sheet conveying direction.

5. A sheet conveying apparatus according to claim 4, wherein said urging means comprises an urging member for urging a trail end of the sheet supported by said sheet supporting means toward the downstream side in the sheet conveying direction with a predetermined urging force.

6. A sheet conveying apparatus according to claim 4, wherein said urging means includes a supply rotary member disposed upstream of said convey rotary member in the sheet conveying direction in a confronting relation to a sheet stacking surface of said sheet supporting means for supplying the sheet supported by said sheet supporting means toward the downstream side in the sheet conveying direction, and a rotation center of said supply rotary member is shiftable toward and away from the sheet stacking surface of said sheet supporting means.

7. A sheet conveying apparatus according to claim 6, wherein said sheet supporting means comprises a stacking plate on which the sheet can be rested and which is shiftable, and a first biasing means for biasing the sheet rested on said stacking plate toward said supply rotary member; and further comprises a second biasing means for biasing said supply rotary member toward the sheet rested on said stacking plate; and wherein a force of said second biasing means for shifting said stacking plate by biasing the sheet is greater than a force of said first biasing means for urging the sheet against said supply rotary member at a position where said supply rotary member acts on the sheet.

8. A sheet conveying apparatus according to claim 7, wherein the force of said second biasing means is greater than the force of said first biasing means from when said supply rotary member applies a supplying force to the sheet rested on said stacking plate.

9. A sheet conveying apparatus according to claim 7, wherein the force of said second biasing means becomes greater than the force of said first biasing means when a predetermined time is elapsed after said supply rotary member applies a supplying force to the sheet rested on said stacking plate.

10. A sheet conveying apparatus according to claim 6, wherein said sheet supporting means comprises a stacking plate on which the sheet can be rested and which is shiftable, and a first biasing means for biasing the sheet rested on said stacking plate toward said supply rotary member; and further comprises a second biasing means for biasing said supply rotary member toward the sheet rested on said stacking plate; and further wherein a force of said second biasing means for shifting said stacking plate by biasing the sheet is set to be smaller than a force of said first biasing means for urging the sheet against said supply rotary member at a position where said supply rotary member acts on the sheet.

11. A sheet conveying apparatus according to claim 10, wherein the force of said second biasing means is smaller than the force of said first biasing means from when said supply rotary member applies a supplying force to the sheet rested on said stacking plate.

12. A sheet conveying apparatus according to claim 10, wherein the force of said second biasing means becomes smaller than the force of said first biasing means when a predetermined time is elapsed after said supply rotary member applies a supplying force to the sheet rested on said stacking plate.

13. A sheet conveying apparatus according to claim 12, wherein a rotation center of said supply rotary member is shiftable in accordance with a thickness of the sheet rested on said sheet supporting means.

14. A recording apparatus comprising:

sheet supporting means for supporting a sheet;

a convey rotary member disposed downstream of said sheet supporting means in a sheet conveying direction for conveying the sheet supported on said sheet supporting means;

a driven rotary member, disposed in a confronting relation to said convey rotary member, to form a nip with and be driven by said convey rotary member; and biasing means for biasing and maintaining said sheet supporting means so that a tip end of the sheet supported on said sheet supporting means is opposed to said driven rotary member;

wherein the bias force of said biasing means is sufficiently light so that said sheet supporting means is shiftable against a bias force of said biasing means by a reaction force applied from said driven rotary member to a tip end of the sheet so that, when the sheet supported on said sheet supporting means is urged toward a downstream side in the sheet conveying direction, the tip end of the sheet is directed to a position adjacent the nip between said convey rotary member and said driven rotary member; and a recording means for recording an image on the sheet conveyed by said sheet conveying apparatus in response to image information.

15. A recording apparatus according to claim 14, wherein said recording means is an ink jet recording system in which the recording is effected by discharging ink in response to a signal.

16. A recording apparatus according to claim 15, wherein said recording means discharges the ink from a discharge opening by utilizing film boiling of the ink generated by thermal energy applied by an electrical/thermal converter.

17. A sheet conveying apparatus comprising:

sheet supporting means for shiftably supporting one of a first kind of sheet having a first thickness and a second kind of sheet having a second thickness, the second thickness being thicker than the first thickness; and convey means having a convey roller disposed downstream of said sheet supporting means in a sheet conveying direction and a driven roller disposed at an upper side of said convey roller for conveying the sheet supported on said sheet supporting means;

wherein said sheet supporting means supports the first kind of sheet so that a tip end of the first kind of sheet is opposed to a nip between said convey roller and said driven roller, wherein a bias force for biasing said sheet supporting means away from the convey roller is sufficiently light so that said sheet supporting means is shifted by a reaction force applied from said driven roller to the tip end of the second kind of sheet so that, when the second kind of sheet supported on said sheet supporting means is urged toward a downstream side in the sheet conveying direction, the tip end of the second kind of sheet is opposed to the nip between said convey roller and said driven roller.

18. A sheet conveying apparatus according to claim 17, wherein said sheet supporting means has a sheet supporting plate and a biasing member which biases said sheet supporting plate to a position where a tip end of the first kind of sheet supported on said sheet supporting plate is opposed to the nip, and said reaction force is larger than biasing force by said biasing member.

* * * * *

UNITED STATES PATENT AND TRADEMARK OFFICE

CERTIFICATE OF CORRECTION

PATENT NO. : 6,106,114

DATED : August 22, 2000

INVENTOR(S): NORIYUKI SUGIYAMA

It is certified that error appears in the above-identified patent and that said Letters Patent is hereby corrected as shown below:

COVER PAGE AT ITEM [57] ABSTRACT:
Line 9, "supporting means" should read --support--.

COLUMN 7:
Line 11, "to" should be deleted.

COLUMN 16:
Line 19, "an" should be deleted; and
Line 38, "sheets" should read --sheets,--.

COLUMN 19:
Line 25, "a" (1st occurrence) should read --the--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*